United States Patent [19]

Choate et al.

[11] 4,054,087

[45] Oct. 18, 1977

[54] APPARATUS HAVING A VARIABLE STROKE RECIPROCATING MEMBER AND MEANS RESPONSIVE TO A PREDETERMINED STROKE TO CONTROL A CIRCUIT

[75] Inventors: Paul V. Choate, Milton; Thomas Papoulias, Brockton, both of Mass.

[73] Assignee: Norris Industries, Inc., Los Angeles, Calif.

[21] Appl. No.: 680,985

[22] Filed: Apr. 28, 1976

[51] Int. Cl.[2] ..... B30B 15/14

[52] U.S. Cl. ..... 100/53; 100/99; 100/229 A; 100/285; 100/290; 141/95

[58] Field of Search ..... 100/53, 99, 229 A, 290, 100/52, 285; 53/124 D, 59 R; 141/95

[56] References Cited

U.S. PATENT DOCUMENTS

| | | | |
|---|---|---|---|
| 3,171,447 | 3/1965 | Fowler et al. | 141/95 |
| 3,424,078 | 1/1969 | Boyd | 100/99 X |
| 3,752,061 | 8/1973 | Hirsch | 100/99 X |
| 3,785,278 | 1/1974 | Hopkins | 100/229 A X |
| 3,822,638 | 7/1974 | Merkin | 100/99 X |
| 3,918,359 | 11/1975 | Hennells | 100/99 X |

*Primary Examiner*—Billy J. Wilhite

[57] ABSTRACT

A domestic trash compactor is provided with electromechanical means operable on a predetermined stroke of its compacting head to control a circuit, in the disclosed embodiment, a signal circuit providing a warning that the compacted trash in the receiver should be inspected.

18 Claims, 12 Drawing Figures

Fig.3
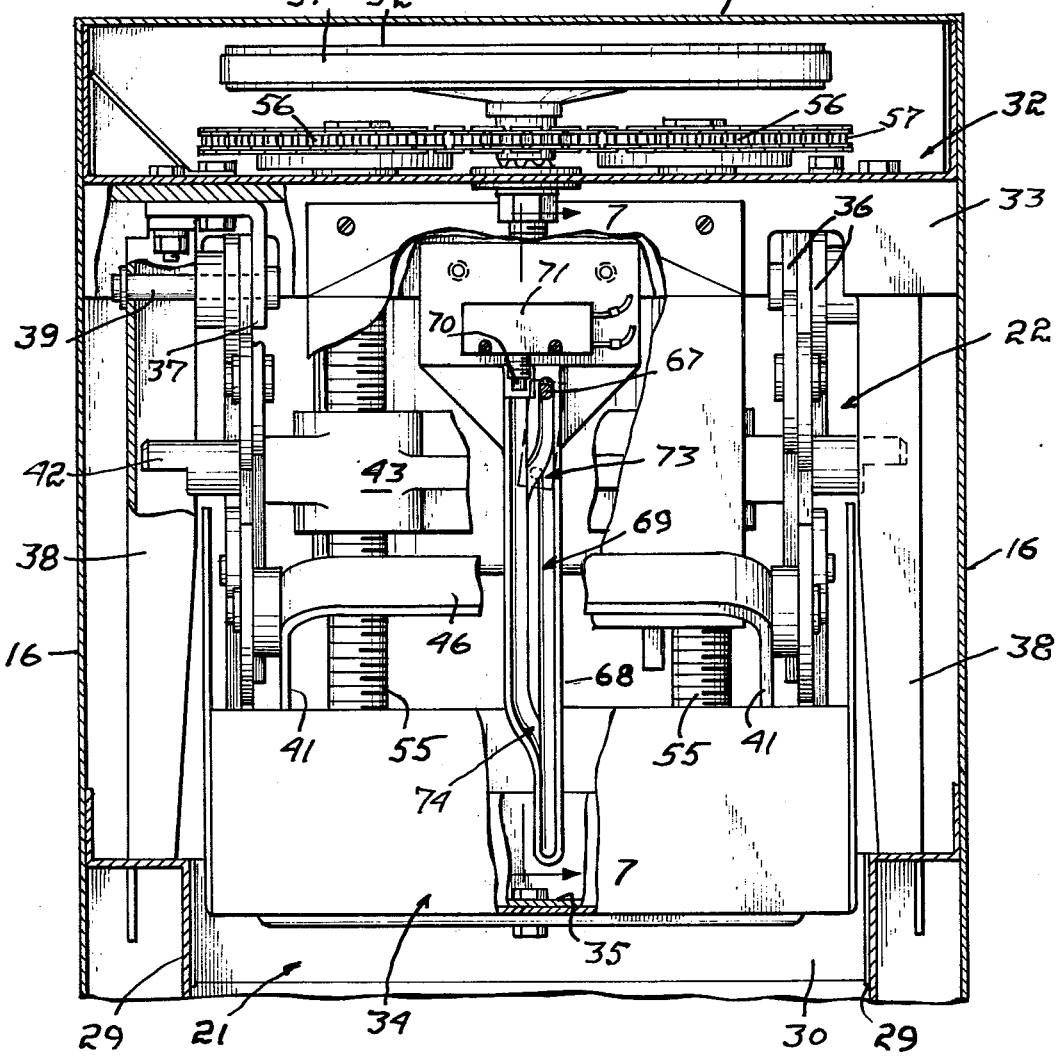
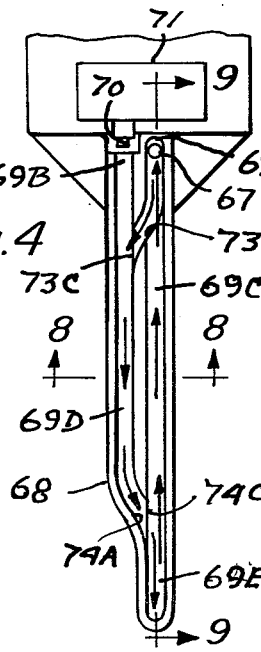
Fig.4
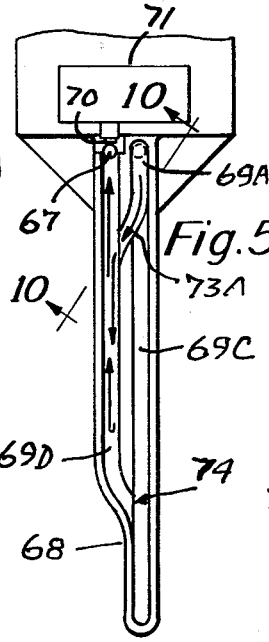
Fig.5
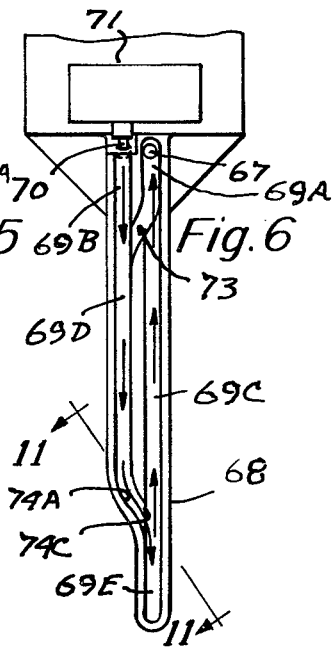
Fig.6

Fig. 9
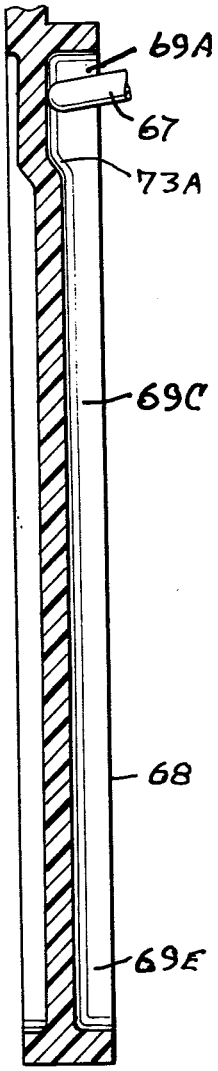
Fig. 10
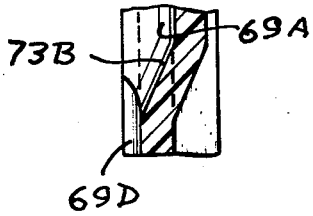
Fig. 11
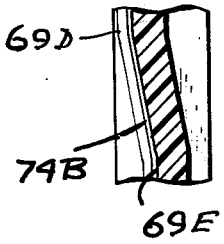
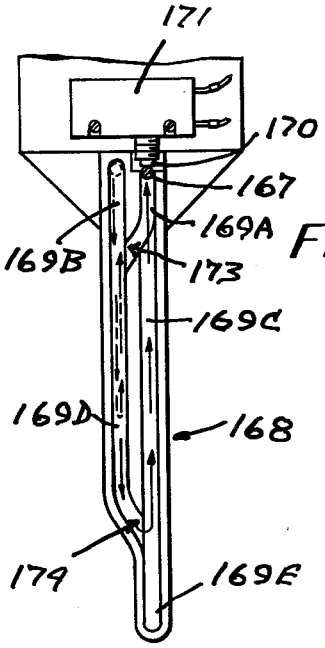
Fig. 12

APPARATUS HAVING A VARIABLE STROKE RECIPROCATING MEMBER AND MEANS RESPONSIVE TO A PREDETERMINED STROKE TO CONTROL A CIRCUIT

BACKGROUND REFERENCES

United States Letters Patent No. 3,752,061, United States Letters Patent No. 3,785,278, United States Letters Patent No. 3,822,638.

BACKGROUND OF THE INVENTION

Apparatus of the type having a reciprocating working element the stroke of which shortens as the work progresses have been provided with means that respond when the stroke has been limited to a predetermined extent.

As an example of such apparatus, reference is made to household compactors. In such compactors, trash is deposited from time-to-time into a receiver within the compactor and from time-to-time, such trash is compacted. The compacting apparatus typically includes a compacting head and the drive by which it is reciprocated includes limit switches by which the drive is reversed if the stroke of the head reaches a predetermined maximum and is halted when the head is returned to a predetermined retracted position. Such drives are also reversible if the compacting head encounters sufficient resistance.

As it is desirable and usually necessary to limit the height of the compacted trash held by the trash receiver within the compactor and as the stroke of the compacting head shortens each time additional trash is entered therein and compactor control means have been provided to prevent further operation of the compactor until the compacted trash is removed once the stroke of the compacting head is shortened to a predetermined extent. Such control means are electrical and require a plurality of switches and appropriate circuitry to provide operation of the control only when the stroke of the compacting head is actually limited by the compacted trash.

THE PRESENT INVENTION

The general objective of the present invention is to provide electro-mechanical control means for apparatus of the type which includes a working element and means to reciprocate it between a retracted position and operating positions with the stroke varying as the work performed increases, the control means responsive to a predetermined stroke length. While the control means may be used to interrupt the operation of the apparatus as a safety measure or otherwise, a particular and important objective is to utilize the control means to signal to the operator that he should inspect the work performed.

Examples of such apparatus are compactors with the control means responsive to a predetermined stroke length that may indicate that the material has been so compacted that the stroke has increased to a predetermined extent or the predetermined stroke length may indicate that the compacted material has built up to an extent such that the stroke length has become shortened to a predetermined minimum.

The general objective, as above summarized, is attained with apparatus having a working element reciprocated by a reversible drive with the length of its stroke varying in a predetermined relation to the work accomplished. Control means incorporated in such apparatus includes a switch responsive to a predetermined stroke length, a follower member, and a track member with which said follower member is in engagement and which includes first and second courses each including an end section representing the retracted position of the element. First and second switches are provided between the courses, the first switch adjacent the end sections and the second switch at a location representing the predetermined stroke length of the element. One of the members includes switching means rendering the first switch operable to transfer the follower member to the second course on appropriate relative movement between the members that effects the travel of the element away from the end sections, and one of the members includes switching means rendering the second switch operable to permit on such relative movement the follower member to pass therethrough and return via the first course if the stroke of the element permits the follower member to pass through the second switch, the follower member otherwise returning along the second course. The control switch is associated with one end section to be operated by the follower member when therein and the other end section receives the follower member until said predetermined stroke length is attained, one member being fixed and the other member including a connection with said reciprocable means operable to cause relative reciprocating movement between the members in proportion to the strokes. Desirably, the track includes an opposite end section of a length such that the follower member is guided by the track through the maximum stroke of the element.

Another objective of the invention is to ensure the switching of the follower member, an objective attained by forcibly shifting one member relative to the other to effect the switching positively, desirably with the follower member resiliently held in proper engagement with the track. In practice, the follower member has a resilient arm and while the resilient arm may also be used to bias the follower member from one course to the other, a particular objective is to provide the first and second switches with cam shoulders to effect biasing and with the arm free to pivot from side to side as the follower member is switched.

Another objective of the invention is to provide a track enabling the cam shoulders to be employed without risk of switching failures, an objective attained with the courses formed by channels, the first course deeper than the second course and the first end section deeper than the remainder of the first course, and with the first switch an upwardly sloping ramp with a drop off into the second course and the second switch a downwardly inclined ramp with a drop off into the first course.

BRIEF DESCRIPTION OF THE DRAWINGS

In the drawings preferred embodiments of the invention are illustrated and

FIG. 3 is a section, on an increase in scale, taken approximately along the indicated line 3—3 of FIG. 2 with parts broken away to show the track of the control in elevation;

FIG. 4 is a somewhat schematic view of the track with arrows indicating the normal path of the follower;

FIG. 5 is a like view showing the path of the follower when the stroke of the compacting head is less than a predetermined minimum;

FIG. 6 is another like view showing the path of the follower when the stroke of the compacting head may again exceed that minimum;

FIG. 9 is a like section but taken approximately along the indicated line 9—9 of FIG. 4;

FIG. 10 is another section, on the same scale, but taken along the indicated line 10—10 of FIG. 5;

FIG. 11 is a like section on the same scale taken along the indicated line 11—11 of FIG. 6; and FIG. 12 is a view similar to FIG. 4 but illustrating another embodiment of the invention.

THE PREFERRED EMBODIMENTS OF THE INVENTION

Figure 1:
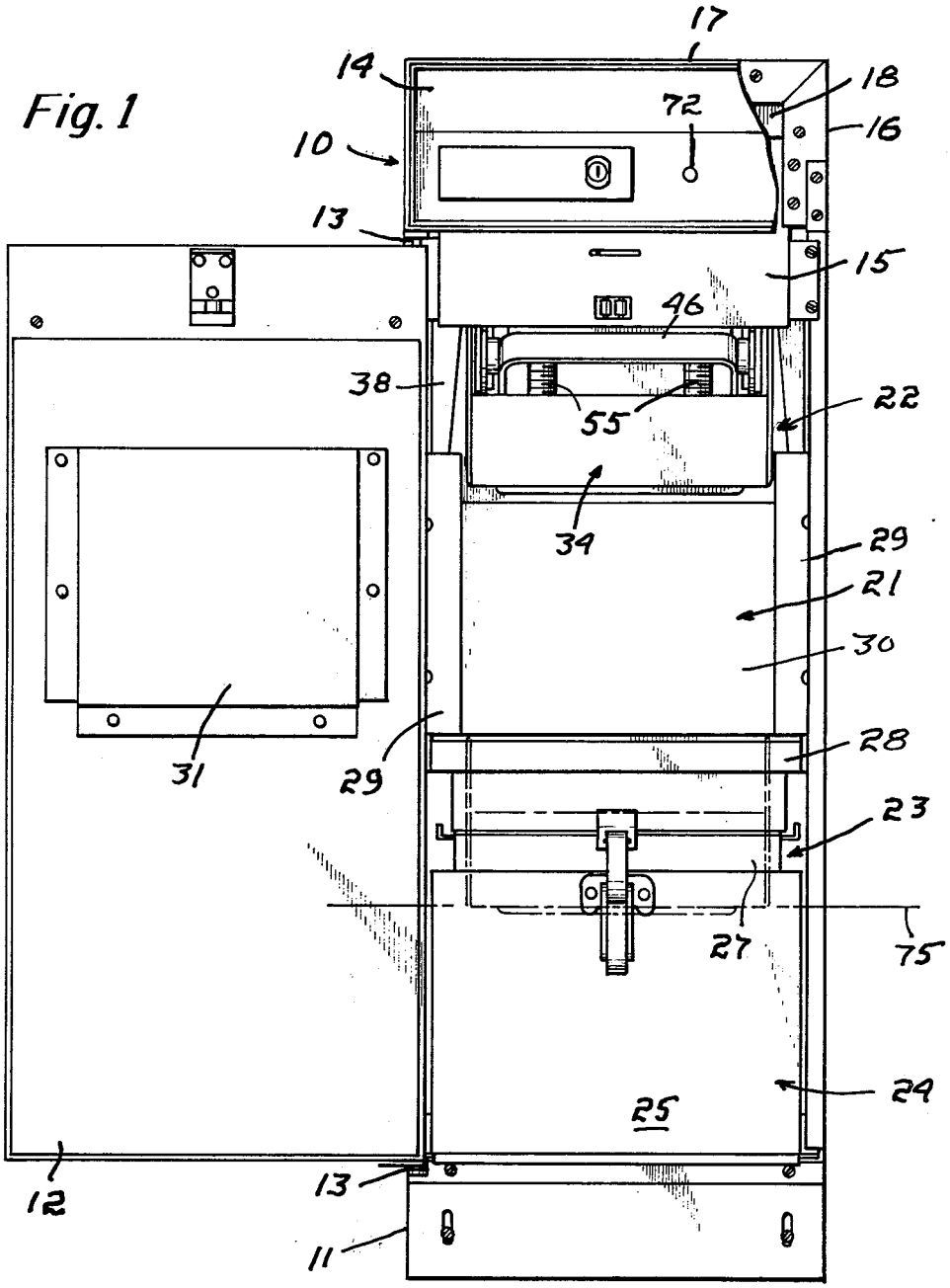
FIG. 1 is a front view of a trash compactor in which the invention is incorporated.

The housing of the household compactor illustrated by the drawings is generally indicated at 10 and includes a base 11 of a construction capable of withstanding compacting pressures, and a door 12 connected by hinges 13 to one side of the housing 10. The door 12 closes the space at the front of the housing between the base 11 and a panel 14 covering the upper part of a mounting plate 15 to which the door 12 is secured when the compactor is in operation and as the means for so doing form no part of the present invention, they are not detailed.

The mounting plate 15 is secured to the inturned front margin of the side walls 16 of the housing 10 and to the downwardly disposed front margins of the top wall 17 thereof to the inner surfaces of which margins, a front shelf 18 is attached. A rear shelf 19 is secured to the inner surfaces of the correspondingly disposed rear margins of the side walls 16 and the top wall 17 and a back or rear wall 20 is detachably secured to the outer surfaces of said rear margins.

Figure 2:
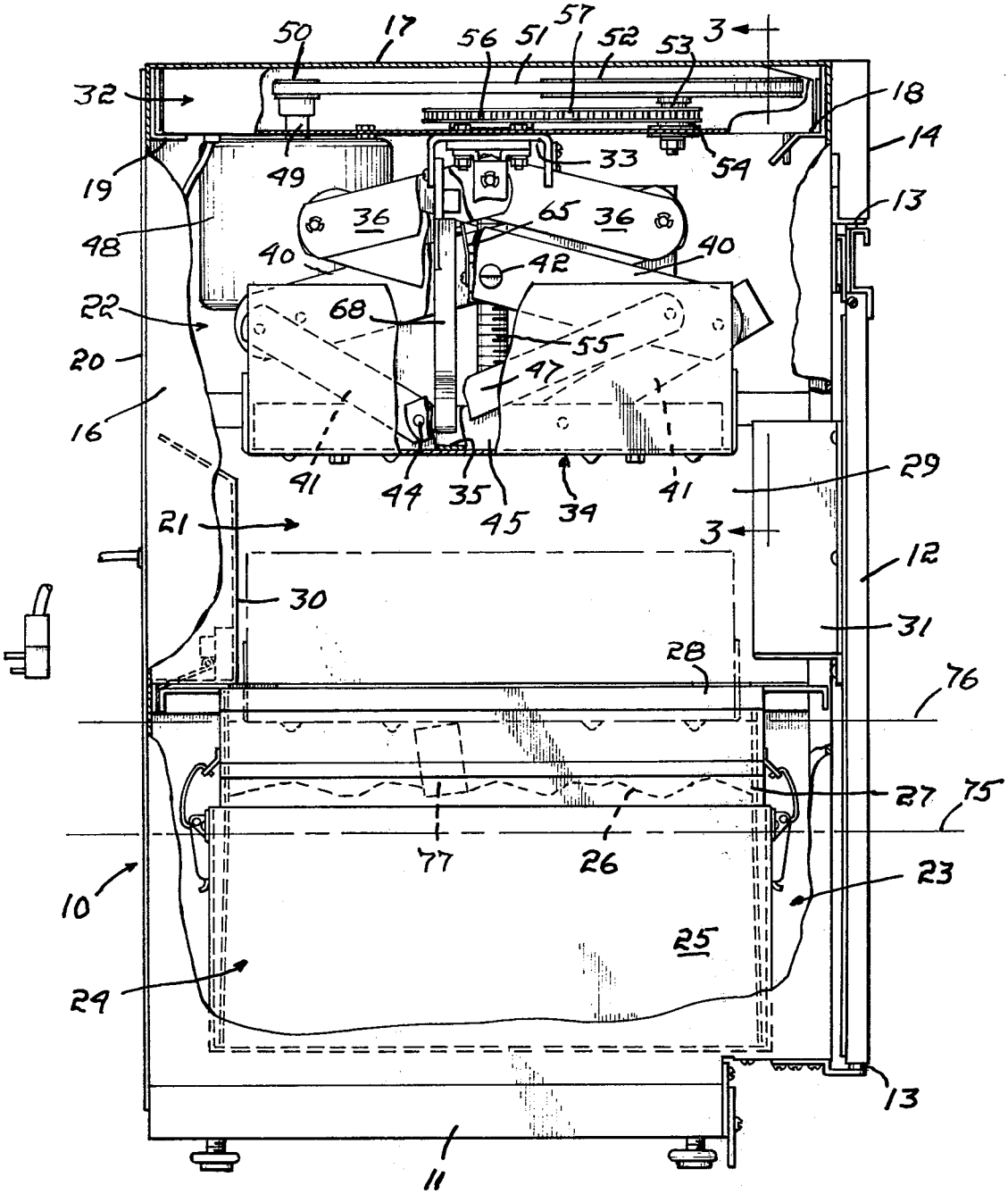
FIG. 2 is a partly sectioned side view of the compactor.

A throat, generally indicated at 21, divides the interior of the housing 10 into an upper chamber 22 and a lower chamber 23 shown as having a trash receiver, generally indicated at 24 positioned therein. In brief, the receiver 24 includes a pan 25 dimensioned to be slid into the chamber 23 and to accommodate the lower part of a trash bag indicated at 26 in FIG. 2, and to have the bottom of a container 27 seated therein, the walls of the container 27 tapering upwardly and inwardly and extending above the pan 25 with their upper margins secured to a frame 28 that fits under the throat 21 and so shielded thereby that trash is funnelled into the container 27.

The throat 21 includes side sections 29 and a rear section 30 secured to the housing 10 and a front section 31 shown as in the form of a container, secured to the inner surface of the door 12 and dimensioned to fit, as the door 12 is closed, between the front ends of the side sections 29. In practice, the throat section 31 shown serves to hold trash bags, a deodorizer, or both.

The compacting means shown in the drawings are the type shown and described in the copending application Ser. No. 672,862 filed Apr. 2, 1976 of Michael A. Nee entitled "Trash Compactor" mailed to the Patent Office on Mar. 31, 1976. In brief, a chassis 32 is detachably supported by the shelf 18 and 19 and includes a centrally located, downwardly opening, transverse channel member 33 secured to the undersurface of the chassis. A compacting head, generally indicated at 34 includes a walled stiffening plate 35 and is connected to the channel member 33 by two sets of links, one adjacent each side of the housing 10. The linkage of each set includes a pair of supporting links 36. An inner depending bracket 37 and an outer depending guide 38 are bolted to the channel member 33 adjacent each end thereof and each bracket 37 and associated guide 38 support a pivot 39 by which the ends of each pair of links 36 are supported. The lower ends of the guides 38 are connected to the side sections 29 of the throat.

The linkage of each side of the housing 10 includes a pair of drive links 40, each pivotally connected at one end to the free end of an appropriate one of the supporting links 36 and at its other end to the upper end of a connecting links 41. The drive links 40 of each set of links are pivotally mounted midway between their ends by the pivot ends 42 of a transverse drive shaft 43, each pivot end 42 extending into the associated guide 38. The other ends of the connecting links 41 of each set of links are pivotally connected as at 44 to the side walls 45 of the stiffening plate 35 of the compacting head 34. The connecting links 41 are shorter than the drive links 40 so that, instead of crossing, their pivots 44 are spaced a substantial distance apart. Corresponding ones of the links 41 of the two series of links include an integral interconnection 46 and the links 40 connected to those links 41 each have a stabilizing link 47 pivotally connected thereto and to the appropriate pivot 44 on the opposite side of a vertical transverse plane inclusive of the guides 38.

The drive shaft 43 is reciprocated vertically by means of a reversible motor 48 below the chassis 32 adjacent the rear thereof and supported thereby with its drive shaft 49 extending upwardly through its bottom and provided with a pulley 50 connected by a belt 51 to a pulley 52, the shaft 53 of which is rotatably supported by the chassis 32 adjacent the front end thereof and provided with a sprocket 54. A pair of vertical screws 55 are threaded through the drive shaft 43 with their upper ends extending through and rotatably supported by the channel 33. The upper end of each screw 55 is provided with a sprocket 56 connected to the sprocket 54 by a chain 57. In practice, the linkage provides that the distance travelled by the drive shaft 43 is less than that of the compacting head 34.

Figure 7:
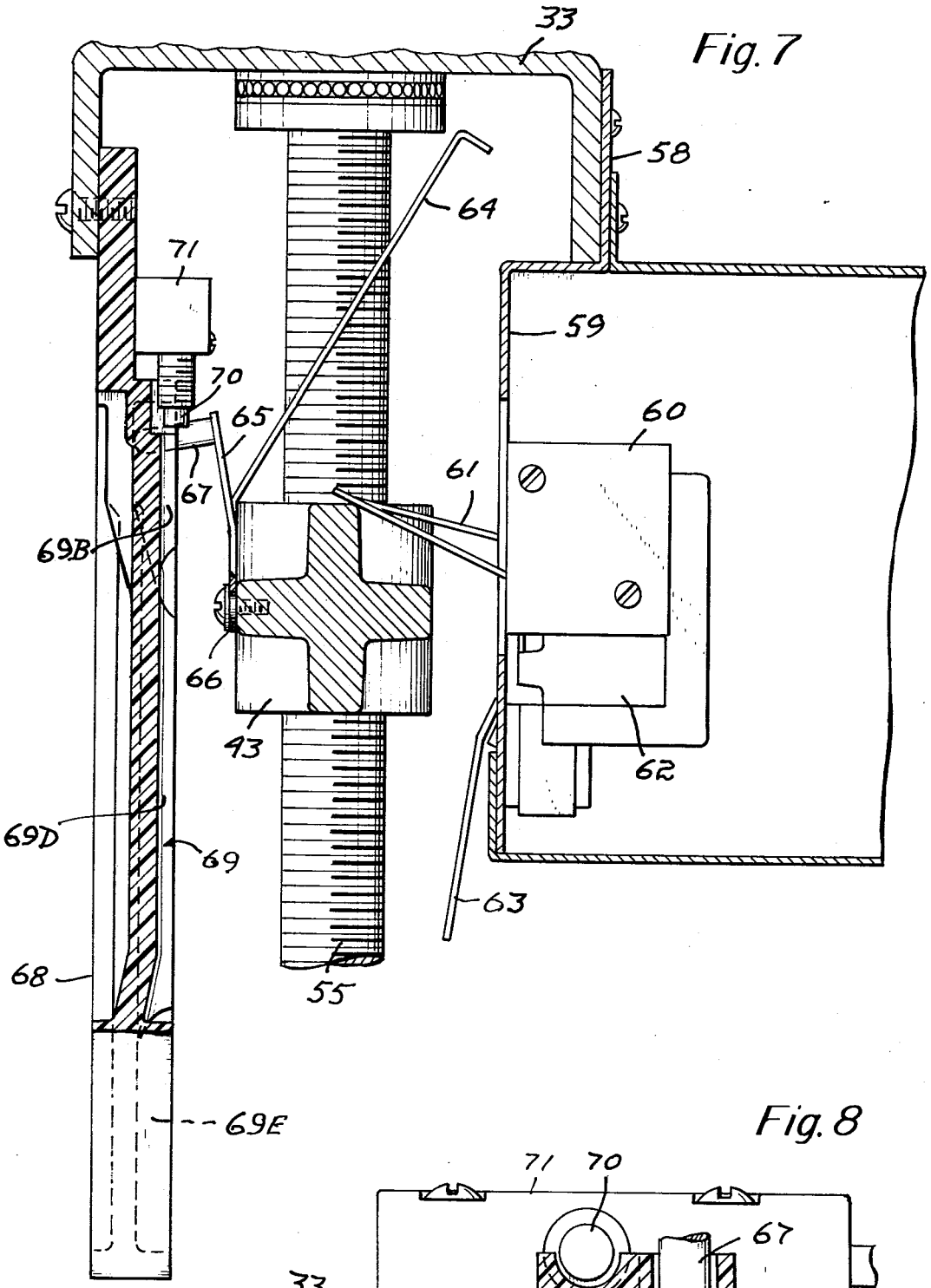
FIG. 7 is a section on a further increase in scale taken approximately along the line 7—7 of FIG. 3.
Figure 8:
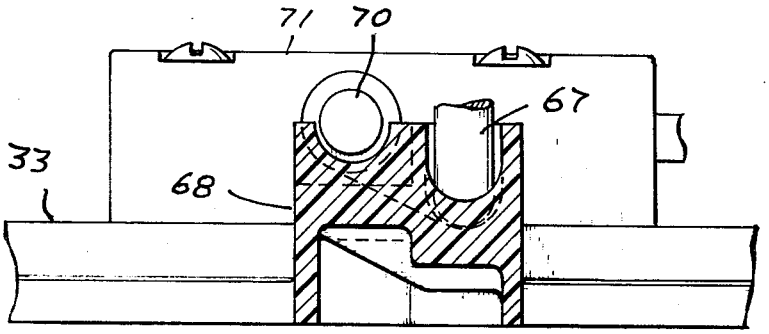
FIG. 8 is a section, on the scale of FIG. 7, taken approximately along the indicated line 8—8 of FIG. 4.

As stated, the motor 48 is reversible and the channel member 33, see FIG. 7, has a bracket 58 in support of a mount 59 for an upper limit switch 60 having an actuator 61 and a lower limit switch 62 having an actuator 63. The actuator 61 of the upper limit switch is operated to stop the drive when engaged by the drive shaft 43 on its upward travel and the drive shaft 43 carries a member 64 engageable with the actuator 63 to operate the lower limit switch 62 when the linkage has been fully extended then to effect reversal of the motor 48.

The motor 48 is of the type that also reverses if the resistance to movement of the compacting head 34 exceeds a predetermined value. As a consequence, as the level of compacted trash builds up in the receiver 25, the drive reverses at increasingly higher levels with the stroke accordingly becoming increasingly shorter.

While the throat 21 is of a construction capable of withstanding compacting pressures, it is of course open at the front when the door 12 is open, and compacted trash obviously should not be permitted to build up above a certain level.

To that end, control means in accordance with the invention are provided, in the disclosed embodiment, to signal whenever a compacting stroke reaches a predetermined minimum. Such means include a resilient arm 65 having a connection 66 with the drive shaft 43 spaced from the member 64 and permitting it to swing laterally relative thereto and including a follower 67. Supported by the channel member 33 is a member 68 and having a pathway or cam track generally indicated at 69 in the form of interconnected channels which function to guide the follower 67 in a predetermined manner as the compacting head 34 reciprocates.

In more detail, the cam track 69, detailed in FIGS. 4–6 and 7–11, includes upper end sections 69A and 69B both representing the uppermost or retracted position of the compacting head 34. The actuator 70 of a normally open switch 71 is positioned in the end of the section 69B and while the circuit is not shown, it includes a light 72 on the front panel 14.

The cam track 69 also includes parallel courses 69C and 69D, the former including the end section 69A and the latter, the end section 69B. A one way course shifter, generally indicated at 73, connects the end section 69A with the course 69D and a one way course shifter, generally indicated at 74 connects the course 69D with the opposite end or junction section 69E of the track. As is apparent from FIGS. 7 and 8, the course 69C is deeper than the course 69D and, see FIG. 9, the end section 69A is deeper than the course 69C which and the junction section 69E are of the same depth.

The course shifter 73 is established by a curved shoulder 73A, a ramp 73B inclined upwardly towards the course 69D with the junction therewith in the form of a barrier 73C. The switch 73 thus compels the follower 67, as it leaves the end section 79A, to enter the course 69D with the barrier 73C effectively preventing its return therefrom into the end section 69A.

The course shifter 74 is similar in that it has a curved shoulder 74A, a ramp 74B inclined downwardly into the course 69C with its junction therewith providing a barrier 74C. Thus on appropriate travel of the follower 67, the course shifter 74 forces it into the course 69C with the barrier 74C effectively preventing the return of the follower 67 into the course 69D.

The normal position of the follower 67, when the compacting head 34 is in its upper inoperative position, is in the end section 69A of the track and its path, during a compacting stroke, is through the course shifter 73 and into the parallel course 69D and through the course shifter 74 and into the junction section 69E. When the compacting head 34 is retracted from its compacting position, represented by the line 75 for example, the follower 67 is prevented by the barrier 74C from returning through the course shifter 74 and hence returns into the end section 69A via the course 69C.

Should, however, the trash have so built up in the receiver 24 that at least some part reaches a predetermined level 76 and represented by the barrier 74C and causes the compacting head 34 to reverse at that level, the follower 67 must then return via the course 69D and as it is prevented from passing back through the course shifter 73 it enters the section 69B and engages the actuator 70 and with the switch 71 then closed, the lamp 72 gives a signal that attention is needed. If in fact, the trash receiver 24 is full, it is removed but if it only needs readjustment of the trash, laying a bottle 77 on its side from a vertical position, by way of example, further trash may be placed in the compactor. In some instances, it may be preferred to have the predetermined level 76 somewhat below the actual "full" level as a safeguard against having more trash in the compactor than can be conveniently and cleanly handled.

In the embodiment of the invention just described, the control is operable when the compactor stroke has shortened to a predetermined extent. In FIG. 12, there is schematically illustrated an embodiment of the invention in which the control switch 171 is operated when the stroke of the compactor head, as represented by the travel of the follower 167 has increased to a predetermined extent.

In the embodiment of the invention illustrated by FIG. 12, corresponding parts are distinguished by the prefix addition 1 to the appropriate reference numerals and such parts are not again described. It will be noted that the switch 171 is located with its actuator 170 exposed in the end section 169A and that the normal position of the follower 167 is in the end section 169B when the compacting head is in its retracted inoperative position. It will be apparent that until the stroke of the compacting head increases to an extent such that the follower 167 passes through the course shifter 174, the control switch 170 remains unaffected but on appropriate travel of the follower 167 permitting it to pass therethrough, it is compelled, on its return travel to enter the end section 169A via the course 169C, then to engage and operate the switch actuator 171.

It will be appreciated from the foregoing, that electromechanical controls in accordance with the invention are simple and inexpensive in construction, are easily installed and as easily serviced, and well adapted to meet requirements whenever a variable stroke, reciprocating element is to be controlled when the stroke of a predetermined length is reached.

We claim:

1. Apparatus including operating means including a working element reciprocated thereby with the length of its stroke varying in a predetermined relation to the work accomplished, control means including a switch responsive to a predetermined stroke length that is a measure that the work accomplished by the reciprocating means has reached a predetermined state, a follower member, and a track member with which said follower member is in engagement and which includes first and second courses each including an end section representing the retracted position of the element, first and second course shifters between said courses, the first adjacent said end sections and the second at a location representing said predetermined stroke length, said first course shifter operable to transfer the follower member to the second course on appropriate travel of the element from the first end section, said second course shifter operable to permit the follower member to pass therethrough and return via the first course if the stroke of the element permits the follower member to pass through the second course shifter, the follower member otherwise returning along the second course, said control switch associated with one end section to be operated by the follower member when therein and the other end section receiving the follower member until said predetermined stroke length is attained, one member being fixed and the other member including a connection with said operating means operable to cause relative reciprocating movement between the members in proportion to the strokes of the element.

2. The apparatus of claim 1 in which the track member is fixed and the follower member is connected to the operating means.

3. The apparatus of claim 1 in which the follower member is initially in the end section of the first course and the control switch is associated with the end section of the second course, the follower member switching to operate the control switch when the stroke length shortens to said predetermined length.

4. The apparatus of claim 1 in which the follower member is initially in the end section of the second course and the control switch is associated with the end section of the first course, the follower member switching to operate said control switch when the stroke length increases to said predetermined length, said predetermined length representing the wanted advance of the working element.

5. The apparatus of claim 1 in which the apparatus is a compactor and the element is a compacting head.

6. The apparatus of claim 5 in which the operating means includes a movable member connected to and moving said element and said one member is connected to said movable member.

7. The apparatus of claim 5 in which the operating means includes supporting linkage of the lazy tongs type to which the element is connected is a compacting member, a drive including a reversible electric motor and a member connecting the drive to the linkage having a stroke proportionally shorter than that of the element, and the follower member is carried by the connecting member.

8. The apparatus of claim 1 in which the track member includes an opposite end section of sufficient length to guide the follower member throughout the maximum stroke of the element.

9. The apparatus of claim 1 in which the follower member includes a resilient arm holding the follower member in engagement with the track member, and the arm is pivotally connected to the operating means.

10. The apparatus of claim 9 in which the arm is pivotable transversely of the two courses.

11. The apparatus of claim 1 in which the track member is a groove and at least one of the course shifters includes a cam surface in the track member and disposed to force the follower member therethrough if travelling in a predetermined direction.

12. The apparatus of claim 11 in which the other course shifter also includes a cam surface in the track member and disposed to force the follower member therethrough if travelling in a predetermined direction.

13. The apparatus of claim 11 in which the groove at least where the follower member is forced to enter through the course shifter is of sufficient depth to establish a drop off as a barrier against the return of the follower member therethrough and the follower member includes a resilient section maintaining the follower member in engagement with the bottom of the courses.

14. The apparatus of claim 12 in which the groove, at least where the follower member is forced to enter through the course shifter is of sufficient depth to establish a drop off at each shifter as a barrier against the return of the follower member therethrough and the follower member includes a resilient section maintaining the follower member in engagement with the bottom of the groove.

15. The apparatus of claim 14 in which the groove of the first course is of greater depth than the groove of the second course, and each course shifter includes a ramp, the ramp of the first course shifter extending upwardly and that of the second course shifter extending downwardly.

16. The apparatus of claim 15 in which the end section of the course normally entered by the element when retracted is deeper than the course on the other side of the first course shifter.

17. The apparatus of claim 16 in which the courses are straight and parallel.

18. The apparatus of claim 1 in which said control includes a warning signal.

* * * * *